US005850857A

United States Patent [19]

Simpson

[11] Patent Number: 5,850,857

[45] Date of Patent: Dec. 22, 1998

[54] AUTOMATIC PRESSURE CORRECTING VAPOR COLLECTION SYSTEM

[76] Inventor: W. Dwain Simpson, 124 Catalpa Rd., Wilton, Conn. 06897-2004

[21] Appl. No.: 897,289

[22] Filed: Jul. 21, 1997

Related U.S. Application Data

[60] Provisional application No. 60/022,026, Jun. 22, 1996.

[51] Int. Cl.[6] ..... B67D 5/378

[52] U.S. Cl. ..... 141/59; 141/45; 141/290

[58] Field of Search ..... 144/5, 59, 7, 45, 144/290

[56] References Cited

U.S. PATENT DOCUMENTS

| | | | |
|---|---|---|---|
| 3,016,928 | 1/1962 | Brandt | 141/45 |
| 5,199,471 | 4/1993 | Hartman et al. | 141/5 |
| 5,213,142 | 5/1993 | Koch et al. | 141/59 |
| 5,217,051 | 6/1993 | Simpson et al. | 141/59 |
| 5,299,605 | 4/1994 | Bergamini et al. | 141/59 |
| 5,417,256 | 5/1995 | Hartsell, Jr. et al. | 141/7 |
| 5,484,000 | 1/1996 | Hasselmann | 141/7 |
| 5,592,979 | 1/1997 | Payne et al. | 141/59 |

*Primary Examiner*—J. Casimer Jacyna
*Assistant Examiner*—Kerry S. Culpepper
*Attorney, Agent, or Firm*—Gottlieb, Rackman & Reisman, P.C.

[57] ABSTRACT

A Stage II Vapor Recovery System that provides for efficient fuel vapor collection while automatically correcting for pressure differentials between the Ambient Atmospheric Pressure and the pressure in the fueling facility's Fuel Storage Tanks (FSTs). The FSTs may be either Underground Storage Tanks (USTs) or Above Ground Storage Tanks (ASTs). The system has advantages over current Stage II systems by providing only the pressure necessary to return vapors to the FSTs without under- or over-pressurizing the FSTs, with the appropriate values of returned volume of vapor to provide Vapor to Liquid Ratios (V/Ls) that ensure efficient vapor collection. It eliminates the anticipated problems associated with earlier Stage II Vapor Recovery systems which work well with current automobile fueling systems, but have unique problems when used with the mandated Onboard Refueling Vapor Recovery (ORVR) systems.

16 Claims, 5 Drawing Sheets

AUTOMATIC PRESSURE CORRECTING VAPOR COLLECTION SYSTEM

This application claims benefit of U.S.C. Provisional application No. 60/022,026 filed Jul. 22, 1996.

BACKGROUND OF THE INVENTION

There are two levels of systems mandated by US and other governments for the safe, efficient recovery of fuel vapors, especially those produced during the process of providing gasoline, methanol, ethanol, and other aromatic automobile fuels such as reformulated gasoline (RFG), to the automotive vehicle market. These two levels are referred to as Stage I and Stage II vapor recovery systems.

Stage I vapor recovery involves recycling the fuel vapors that are in the volumes of Fuel Storage Tanks (FSTs) above the level of liquid fuel. This volume is defined as the Ullage of the storage tank. When a fuel transport vehicle discharges fuel into the FST, a return hose allows the vapors in the FST ullage to be forced back into the fuel transport tank by the displacement of the vapor volume with the newly dispensed fuel. Thus, a fuel transport will arrive at a fueling facility with a full tank of fuel and return with a full tank of fuel vapors.

Although Stage I is an important part of the overall vapor recovery requirements, it is not directly associated with the individual vehicle refueling at the fueling facility, and is not addressed by this invention.

Stage II vapor recovery involves recycling the vapors displaced from vehicle fuel tanks during refueling of the vehicle. Stage II systems must efficiently return the vapors from the vehicle tank to the FST (either UST or AST) during the refueling process in order to prevent vapors escaping into the atmosphere, especially when an individual is actively involved in the refueling process. As more and more of our service stations have become self-serve, it is even more important to avoid allowing fuel vapors (especially gasoline fumes) to escape into the air during refueling. There are two main types of Stage II vapor recovery systems, the Balance System, and the Vacuum Assist System. Each has unique advantages and disadvantages.

The Balance System of vapor recovery is similar to the typical Stage I system, except it is applied to the fuel transfer system between the FST and the vehicle fuel tank. In the Balance system, a vapor return line from the fuel dispenser is extended via a coaxial hose (fuel in the inner hose, vapors in the outer hose) to the fuel dispensing nozzle. At the spout end of the nozzle a bellows extends the vapor return path around the spout and against the vehicle fill-pipe opening. A tight seal of this bellows against the vehicle fill-pipe is required so that all displaced vapors are forced back through the bellow, into the nozzle, through the coaxial hose, and back to the FST.

The advantages of the Balance system include a simple design, and automatic balancing of the vapor returned to the volume needed to replace the fuel removed from the FST during refueling. Although the Balance system can not perfectly provide the balance of volume required, due to some "vapor growth" in the FST when "new" vapors are returned to the FST, this technique has proven to be efficient enough to provide adequate vapor recovery in fuel dispensing facilities.

The major disadvantages of the Balance system involve the difficulty of insuring a tight seal (some force is required), heavy nozzles, and easily torn bellows. In many cases, the Balance system does not adequately collect vapors simply because it is difficult to insure that the proper vapor seal is present.

The second Stage II vapor recovery system, Vacuum Assist (VA), overcomes the disadvantages of the Balance system by providing a lighter nozzle with no bellows. The vapors are collected by the use of a vacuum pump somewhere in the vapor return system either in the dispenser, vapor return line, or in the FST assembly. In order to achieve the required efficiency, the vacuum pump must be controlled by electronic logic or by direct correlation to the rate of dispensing of fuel. In some cases this is done by electronically monitoring the fuel flow meter and electrically driving the vacuum pump at speeds which are determined to provide the best recovery response for a given fuel flow rate. In some electronically controlled VA systems, adjustments are made to the response of the vacuum pump during start-up, low-flow, or at the end of the cycle. Other VA systems are simply mechanical systems which drive the vacuum pump directly in response to the fuel flow, usually with a fuel motor driving a vapor pump via a shared axis. Other schemes exist which provide the vacuum by other techniques, such as atomization of a portion of the fuel flow to generate a vacuum (and condensed liquid) in the vapor return line. In all cases, the VA systems are designed to provide for a certain value of V/L either constantly during the fueling episode, or by fixed variations during certain parts of the dispensing episode. Thus all present VA systems are essentially positive displacement systems, providing for a fixed amount of vapor to be pumped back to the FST for a given amount of fuel dispensed. The major disadvantage of VA systems is the requirement to carefully determine the proper V/L ratio and maintain this setting for the extended operation of the system. Maintaining this adjustment has proven to be very difficult, especially as a function of seasonal changes. When the amount of collected vapor is too small, more vapor escapes into the atmosphere from the area of the vehicle fill-pipe, and the overall efficiency of the system is degraded. When the amount of the recovered vapor/air mixture is too great, the FST will become over-pressurized and vapors will be discharged into the atmosphere, again degrading the efficiency of the system.

Another significant problem with many VA systems involves the geometry of the dispensing hose. Most VA systems use an "inverted" coaxial hose—one with the vapor return path in the inner hose, and fuel dispensed in the outer hose. The claimed advantages of this system are that the small vapor path permits the clearing of the vapor path by suction of the vapor pump, which can have pressure heads of over 100 inches of water ("in $H_2O$") in order to clear out a liquid (fuel) column as long as the length of the hose. This capability allows the VA pump to clear out any "condensed" vapors in the vapor path, which it does very well. However, with such a high vacuum pump capability, it is also possible to suck fuel from the vehicle fill-pipe itself, especially during "splash-back" and "top-off". This fuel is returned to the FST under action of the VA system and essentially decreases the total amount of fuel dispensed in to the consumer.

Some VA systems have attempted to overcome the variation in performance by deliberately operating at V/Ls of significantly greater than 1.0, and relieving the pressure in the FST by burning ("Processing") the expelled vapors before they enter the atmosphere. However, this essentially trades one kind of environmental problem for another, since the burning of the excess vapors essentially produces the same greenhouse gases as are generated by automobiles or other combustion engines. Again, experience has shown that significant amounts of fuel are sucked out of vehicle fuel fill pipes when the vapor flow rate is this great. This fuel is fuel that has already been paid for by the customer but is returned to the FST—increasing the effective cost of the resulting dispensed fuel. Unless much of this returned fuel is processed by the burners, the service station operator could find himself with a significant constant positive variation in fuel inventory—one that could be excessive from a weights and measures viewpoint.

There is an obvious need to supply a better vapor recovery system to the fuel dispensing industry—one that is compatible with a) the extant non-ORVR vehicle population of the mid-1990's, b) the expected population of mixed non-ORVR and ORVR equipped vehicles in the 1998–2015 period, and c) the population of all ORVR equipped vehicles after the year 2015.

This application describes such a system and the technology upon which it is based.

SUMMARY OF THE INVENTION

A vapor recovery system that utilizes an automatically adjustable low-pressure vacuum pump in conjunction with coaxial or equivalent fuel/vapor delivery hoses, vapor recovery nozzles, vapor valves in the dispensing end of the hose (either in hose or nozzle), and properly specified pressure-vacuum (PV) valves in the vent pipes of the FSTs can produce excellent vapor recovery efficiencies while providing the advantages of both the balance vapor recovery system and the vacuum-assist vapor recovery system without the inherent problems of either. It also eliminates the need for expensive and difficult-to-maintain "processor" systems described earlier.

A vapor recovery pump has been designed and implemented (U.S. Pat. No. 5,217,051) which has exactly the features required. When this pump is used in the invention described below, efficient and inexpensive vapor recovery is possible for all combinations of vehicles to be fueled, with any mix of ORVR or non-ORVR equipped vehicles.

A low-pressure pump is desirable because of the need to control the pressures in the FSTs. It is desirable to keep the pressure in an FST as near atmospheric pressure as possible without either allowing vapors to escape into the atmosphere or allow too much air into the FST. The pressure must also be maintained such that the vapor recovery return lines to the FST from the fuel dispensing position are not pressurized enough to cause "fugitive emissions" at any leak points in the nozzle/hose/dispenser/plumbing system. Fugitive emissions are of particular concern if a fuel dispensing facility is not "tight" and vapors can escape into the atmosphere in several locations not easily monitored by vapor detection systems.

Typically, FSTs are maintained within pressure limits of only a few inches of water ("in $H_2O$") pressure relative to atmospheric pressure (Standard atmospheric pressure is about 407 inches of water). PV valves may be set, for example, to a positive pressure of 2.0 in H2O and a negative pressure (vacuum) of −6 in $H_2O$. Except in very rare cases of extremely sudden atmospheric pressure changes (low fronts due to hurricanes, etc.), the established ranges of pressures set for the PV valves will prevent vapors from escaping the FSTs and prevent too much fresh air from entering the FSTs.

A particular concern about Phase II vapor recovery systems as more and more vehicles become equipped with ORVR is the problem of "vapor growth" in the FSTs. Vapor growth occurs when fresh air is ingested into the Ullage of the FST and mixed with the vapors already in the FST. Because of the diverse mix of hydrocarbons in the fuel (gasoline, for example can contain hundreds of hydrocarbons in its formulation) various components of the fuel can vaporize and mix with the air/vapor mixture until a stable vapor concentration is achieved, usually at a higher pressure than before the stability is achieved.

Since the extant VA systems are designed to deliver a constant (within tight limits) vapor volume to fuel dispensed ratio (V/L ratio), a serious over-pressurization (due to vapor growth) can occur when some of the vehicles fueled are equipped with ORVR. The only protection for the FST is then to expel vapors into the atmosphere via the PV valve(s). The effective efficiency of these VA systems will then decrease and become essentially non-effective as the ORVR population increases over the next 15 to 20 years.

The "Processorm" systems will be able to permit stabilization of the FSTs by simply burning off the excess vapors—but this means that more and more fuel will be burned in a wasteful manner and even more greenhouse gases will be expelled into the atmosphere. A better system would prevent the burning of this fuel, which should be safely contained in the FSTs.

An automatically adjusting low-pressure pump avoids all of the problems described above. If the pump described in U.S. Pat. No. 5,217,051 is incorporated into a vapor recovery system such that one pump is installed for each dispensing point (either external to the fuel dispenser or installed within the dispenser), then the vapor recovery is controlled independently for each fueling position. The pump is so designed that at FST pressures near atmospheric pressure it operates with a V/L ratio of very near 1.0. However, at FST pressures greater than atmospheric, the value of the V/L will decrease slightly so that pressurization of the tank will not occur and the FST pressure will automatically adjust downward to atmospheric. At FST pressures below atmospheric, the pump will operate at a V/L of slightly greater than 1.0 so that the FST pressure is automatically adjusted upward to atmospheric. Since these very minor adjustments are made on every fueling episode, any variation in FST pressure due to atmospheric changes or vapor growth due to air ingested (from fueling ORVR vehicles, for example) into the FST will automatically be corrected toward atmospheric. No vapors will be lost from the FST, and there is no requirement for additional vent vapor processors or electronic control of the vapor pump operation.

DETAILED DESCRIPTION OF THE INVENTION

Overview of System

Figure 1:
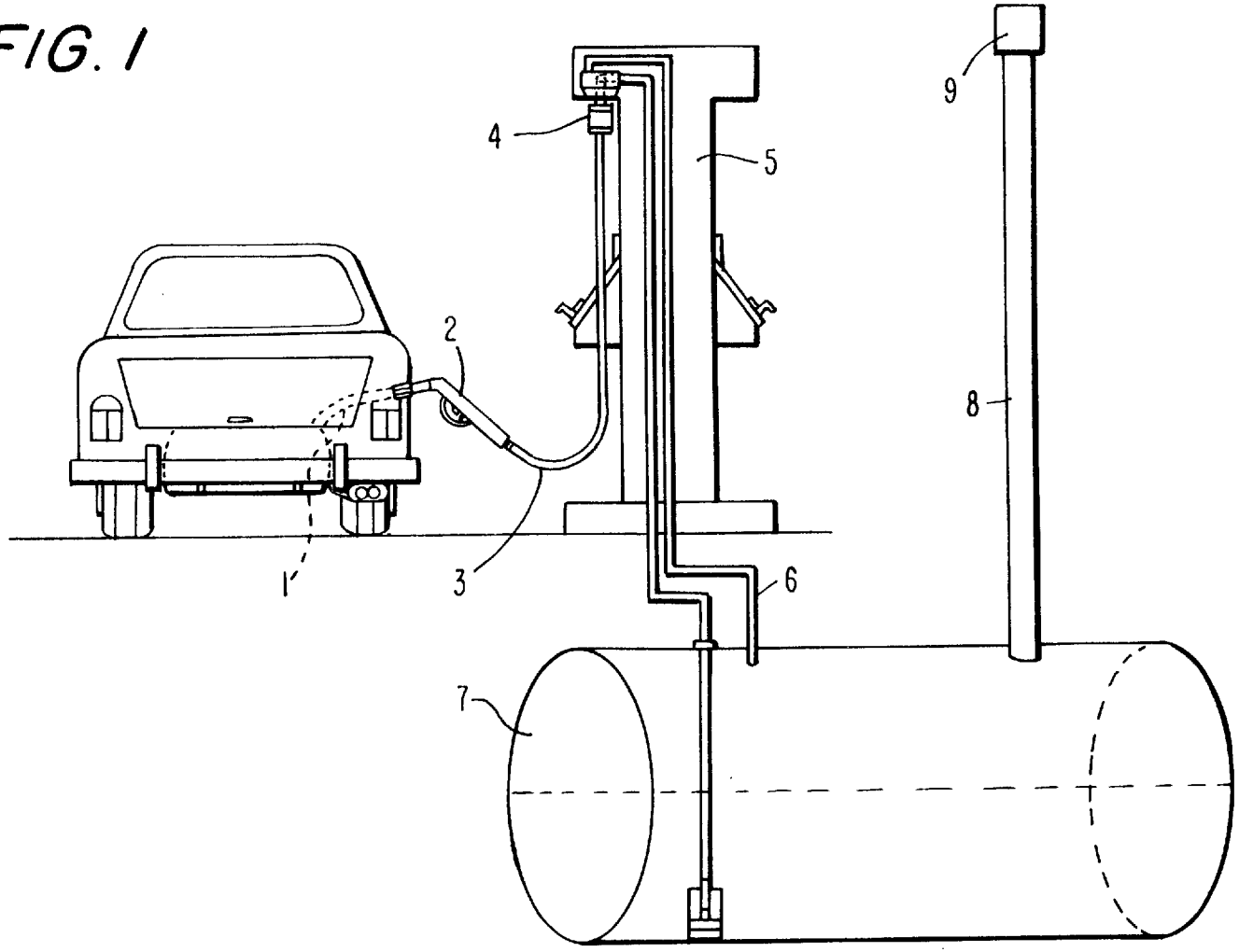
FIG. 1 is a schematic view of the inventive system.

An overview of the system defined by this invention is given in FIG. 1. The system is shown as a single fueling point with a single fuel and vapor return line and a single FST, but the extension to actual fueling facilities with multiple fueling points and multiple FSTs is obvious.

In FIG. 1, the system is shown to consist of 1) an automotive fuel tank and fill-pipe, 2) a fuel dispensing nozzle with vapor recovery capabilities, 3) a hose system which provides for both fuel delivery and vapor recovery (i.e. coaxial vapor recovery hose), 4) a low-pressure, automatically adjustable vapor pump, 5) a dispensing unit which controls the fuel delivery, 6) fuel and vapor return lines to the FST, 7) a sealed FST which contains both fuel and fuel vapor space, 8) vent lines which permit vapors to flow from the FST to atmosphere or air to flow from the atmosphere to the FST, and 9) pressure/vacuum (PV) valves on the vent lines to maintain the FST vapor pressure within set limits. The Stage I ports for fuel delivery (with drop tubes) and vapor recovery are not shown, although they are required in all FST installations.

System Operation

When fuel is dispensed via nozzle (2) into the vehicle fuel fill pipe (1), a vapor/air mixture is drawn back from the fill-pipe area via the vapor recovery hose (3) by the operation of the vapor pump (4). In standard vehicles without ORVR, this vapor/air mixture has a high hydrocarbon (HC) concentration, since it is mostly the vapor being displaced from the vehicle fuel tank. In vehicles equipped with ORVR, the HC concentration will be much lower, since the vapor/air mixture will be due only to vapors in the fill-pipe mixed with air drawn in from the atmosphere. In either case, essentially the same volume of vapor/air mixture will be returned to the FST (7) via the vapor return lines (6). If the vapor pump V/L ratio is near 1.0 and the FST vapor pressure is near atmospheric, the vapor pressure in the ullage of the FST will not change significantly, and no vapors will escape via the vent lines (8) through the PV valves (9). If there are changes in the FST vapor pressure due to other effects (atmospheric pressure changes, large fuel drops, etc.), then the vapor pump operation will change automatically as described below, so that the FST pressure is always adjusted toward a stable pressure very near atmospheric. Since these pressure changes are made dynamically, responding to pressure changes at every vehicle fueling episode, very little variation in the FST pressure occurs, and the efficiency of the vapor recovery system stays at optimum levels.

The active pressure of the low pressure vapor pump is such that very little, if any, fuel can be drawn back into the vapor path of the coaxial hose. However, some condensation can occur and liquid fuel can accumulate in the vapor path over time. This is easily removed by standard venturi techniques included in coaxial hoses. The liquid fuel is thus returned to the fuel path in the hose or at the nozzle and is returned to the customer rather than to the FST.

Vapor Pump Operation

The vapor pump used in this invention is the vapor pump described earlier (U.S. Pat. No. 5,217,051) which has the automatically adjustable features required for this system. It is obvious that other vapor pumps could be used if logic (electronic, hydraulic, pneumatic, or mechanical) were provided to control the V/L value of the vapor pump as a function of the FST pressure relative to atmospheric, and such a combination of such logic and vapor pump is equivalent to an automatically adjustable vapor pump as described in this patent and is covered in the claims of this patent.

Figure 2:
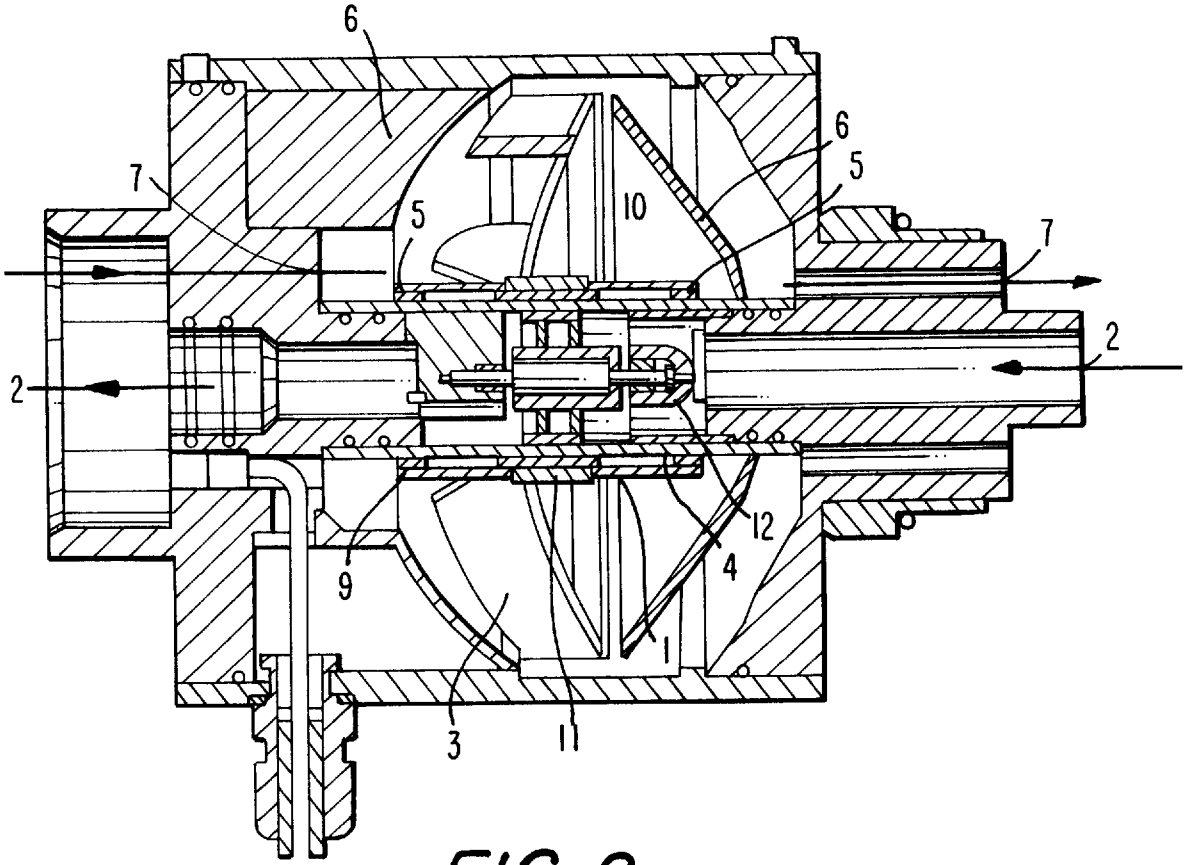
FIG. 2 is a cross-sectional view of the preferred embodiment of the vapor pump.

The preferred embodiment of the vapor pump is shown in FIG. 2. The vapor pump is a fuel driven vapor pump, basically consisting of a fuel motor consisting of a rotor (1) placed in the fuel flow path (2) and constructed such that the fuel flow causes the rotor to rotate. A fuel flow director (12) upstream of the rotor shapes and directs the fuel flow for optimum performance and energy transfer to the rotation of the rotor. The fuel rotor has inserted in the outer ring of the rotor a plurality of magnets (10) arranged in such a way as to provide for optimum magnetic coupling with a similar set of magnets (11) arranged on the inner ring of a vapor impeller (3). The fuel rotor is supported by appropriate bushings and/or bearings (9) which permit the rotor to rotate freely under the influence of the fuel flow and at the rotational speeds required for driving the vapor impeller. The fuel rotor and the fuel flow is contained within a non-magnetic tube (4) which permits magnetic field lines to penetrate the tube and couple with the magnetic fields of the vapor impeller. The vapor impeller is so designed to permit it to spin around the fuel tube at the same rotational speed as the fuel rotor, since the two are magnetically coupled and act as a single rigid body within the limits of the magnetic coupling force. The vapor impeller is supported by a precision bearing system (5) which permits it to operate at the high rotational speeds required to pump the vapors from the vehicle fuel fill-pipe all the way back to the FST at the operational pressures of the system. The vapor flow directors (6) within the pump are so designed to provide for optimum vapor flow through the pump via the vapor return path (7) at the operational speeds and pressure. The electrical power and signal cable assembly (8) is not part of the function of the pump and is only used in the embodiment of the pump when used with electronically enable nozzles. For mechanical vapor recovery nozzles, this cable is not part of the pump assembly.

The low pressure pump is designed to operate with fuel nozzles and hoses which have pressure drops below the operating ("dead-head") pressure of the pump at typical Ad vapor flow rates. The system operation is optimized when the total system impedance (nozzle, hose, plumbing) is about 1 in $H_2O$ pressure below the pump dead-head pressure. This assures the correct variation of V/L as a function of FST pressure when PV valves are employed to maintain FST pressure limits.

Figure 3:
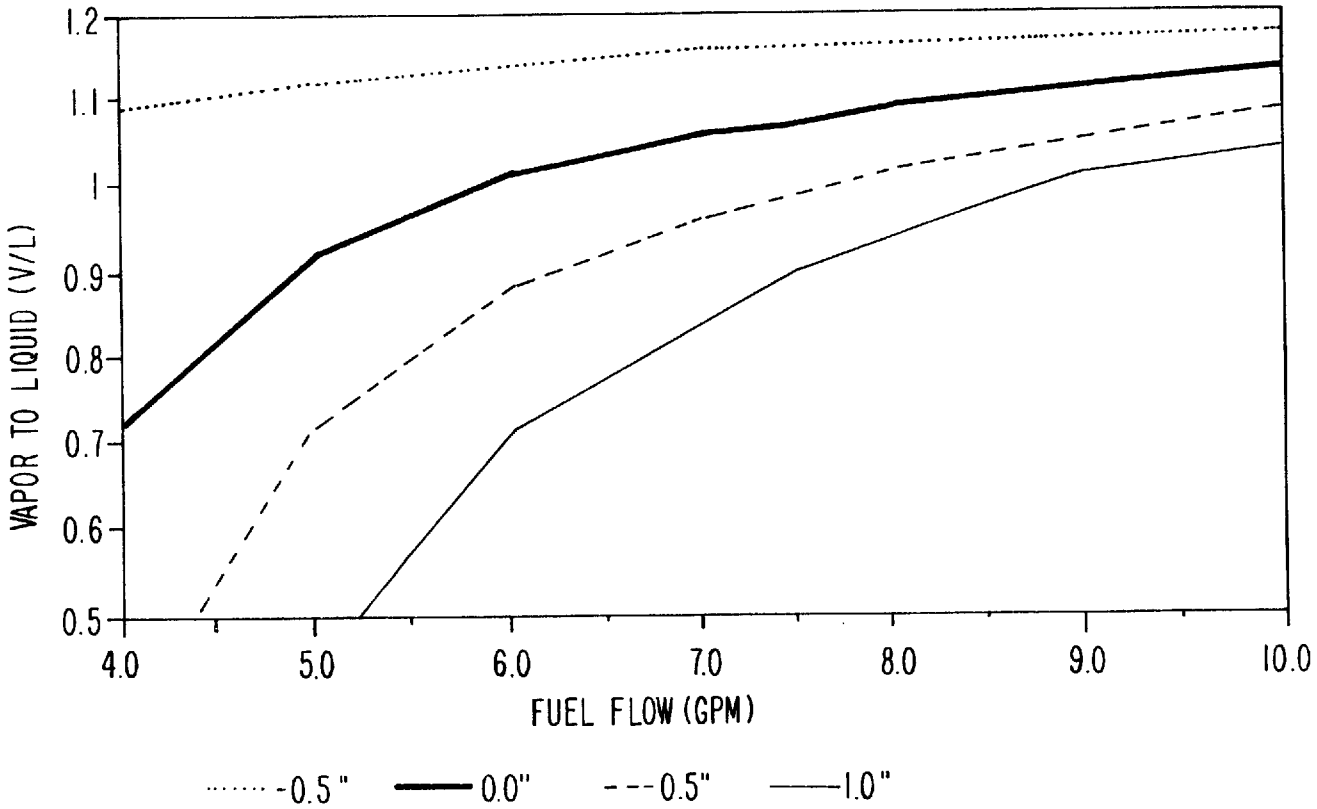
FIG. 3 is a graph showing operation of the pump for FST pressures as compared to typical fuel flow rates.
Figure 4:
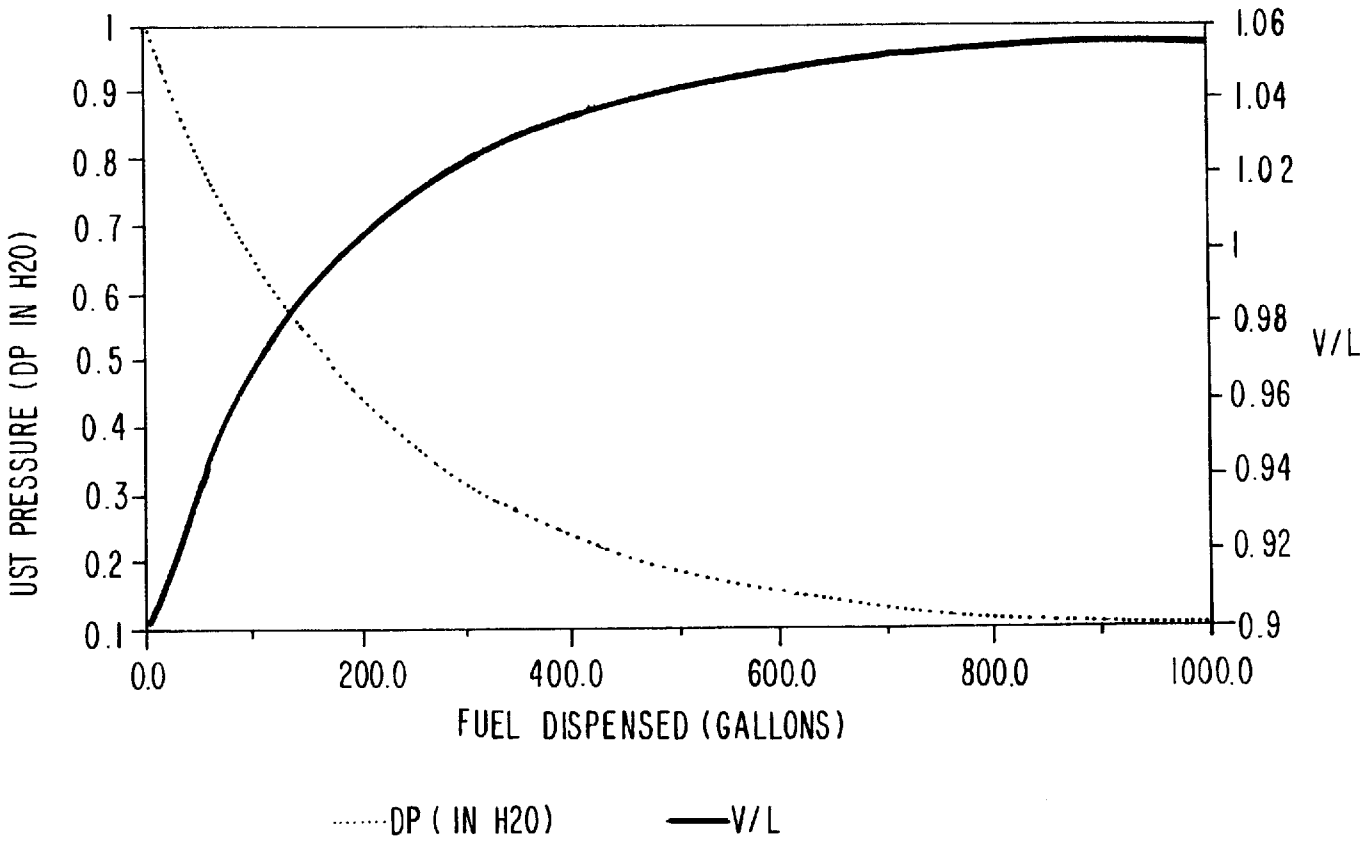
FIG. 4 is a graph showing the automatic adjustment for *pressure.

The operation of the pump is such that at FST pressures below atmospheric, the pump operates at V/L values greater than 1.0, and at FST pressures above atmospheric at V/L levels slightly over 1.0, with the V/L ration decreasing below 1.0 if the FST pressure approaches the positive pressure value of the PV valve. The operation of a typical pump is shown in FIG. 3 for 4 FST (−0.5, 0.0, 0.5, and 1.0 in $H_2O$) pressures over typical fuel flow rates. The automatic adjustment for pressure is shown in FIG. 4, where an FST (about 5000 gal ullage) pressure of 1 in $H_2O$ is seen to quickly decrease as fuel is dispensed and the operation of the pump stabilizes at about 0.1 in $H_2O$ with a steady V/L of about 1.05. This particular recovery cycle could happen when some external process (such as a fuel drop on a hot day or a sudden drop in atmospheric pressure) artificially raises the pressure above the desired normal operating values. Normally the adjustment of the FST pressure is less dramatic, since the FST pressure would never vary greatly from one fueling episode to another. In current systems the PV valve is typically set at 2 in $H_2O$ positive pressure, and the pump described here is shown to have optimum performance below that pressure level, automatically maintaining an FST pressure very near atmospheric. Normal variations in atmospheric pressure also occur slowly, allowing the vapor pump again to maintain the appropriate FST pressure.

Figure 5:
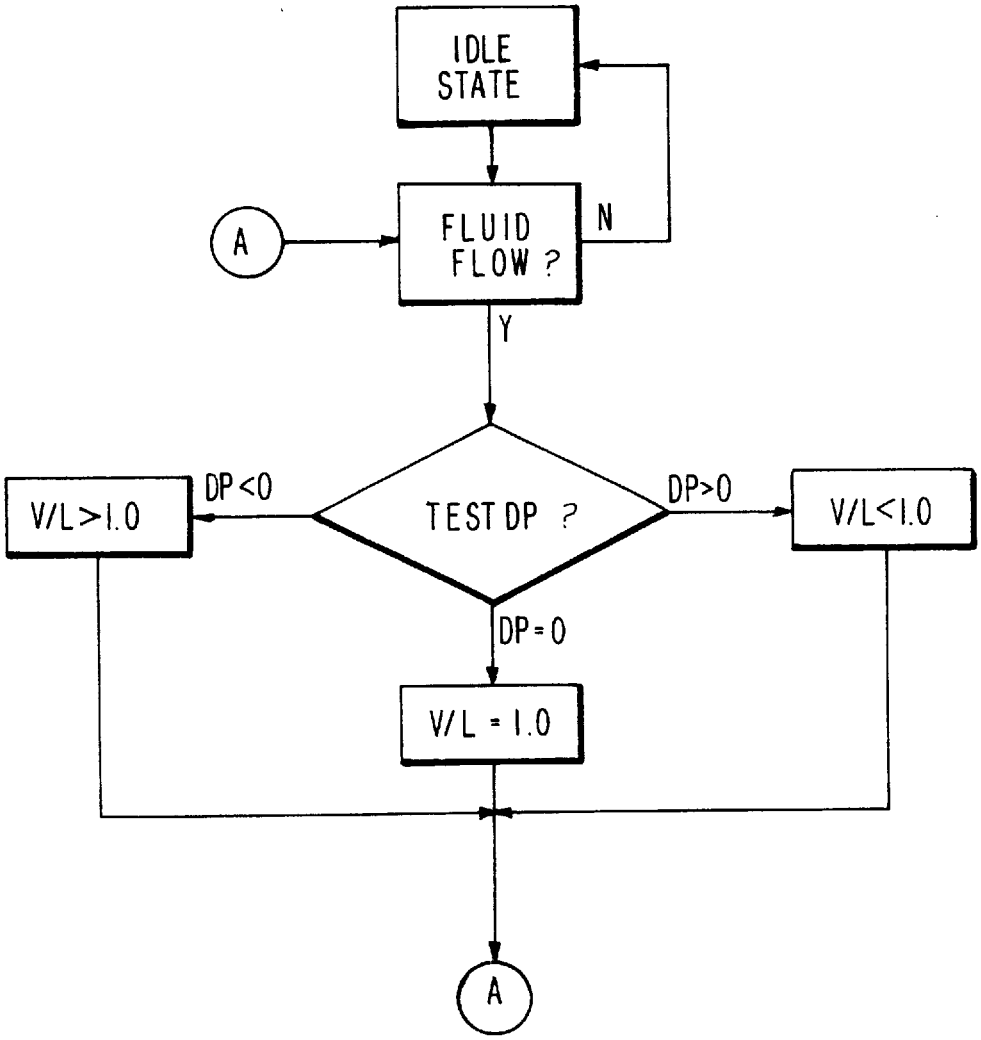
FIG. 5, is a flow diagram showing system logic.

The logic of the system described in this invention is shown in FIG. 5. Whenever a differential pressure (DP) between the FST ullage and atmosphere is greater than zero, the pump would pump at a V/L of slightly less than 1.00 (e.g.

0.95) while if DP is less than zero, the pump would pump at a V/L of slightly greater than 1.00 (e.g. 1.05). At a DP of exactly zero, the pump would pump with a V/L of exactly 1.0. With the pump operating in this manner, the FST would be maintained at a pressure very near to atmospheric at all times due to the action of the vapor recovery pump. However, the pump can be so designed to vary the V/L values as a function of DP so that the FST would be maintained at either a very small positive pressure or a very small negative pressure. In either case, the effect of fugitive emissions would be negligible, and the V/L setting would permit for efficient vapor recovery. Within manufacturing tolerances, the pump can be built to maintain DP within a few tenths of an inch of water pressure, so that no field adjustments to V/L values are ever required.

It should be noted that the logic of FIG. 5 is automatic in the preferred embodiment of this invention, since the low pressure vapor pump described was designed to work exactly in this manner. However, it is obvious that any vapor pump capable of independent control by way of external logic (i.e. using pressure transducers to control the speed of an electrically controlled pump) will work in the same manner and is incorporated in the application of this invention.

I claim:

1. A vapor recovery system comprising:

a fuel dispensing nozzle capable of recovering fuel vapors;

a fuel dispensing hose connected at one end to said nozzle and designed for delivering fuel to and recovering fuel vapors from said fuel dispensing nozzle;

a vapor recovery pump driven by a dispensed fuel cooperatively connected to said fuel dispensing hose for controllably collecting recovered fuel vapors;

a dispensing unit for controlling fuel delivery;

at least one fuel storage tank containing both fuel and vapor storage space;

fuel dispensing and vapor recovery lines extending between said dispensing unit and said at least one tank;

wherein said vapor recovery pump automatically adjusts the ratio of collected fuel vapors to dispensed fuel in response to changes in vapor pressure in said at least one tank in order to maintain vapor pressure in said at least one tank within a certain pre-defined range.

2. The system of claim 1, further including at least one vapor venting line extending from said at least one tank into the atmosphere.

3. The system of claim 2, wherein said at least on vapor venting line includes at least one pressure/vacuum valve for selectively controlling vapor pressure in said at least one tank.

4. The system of claim 3, wherein said vapor recovery pump further includes a vapor impeller for pumping recovered fuel vapors for collection by said at least one fuel storage tank.

5. The system of claim 3, wherein said vapor recovery pump further includes a fuel flow director located upstream of the rotor.

6. The system of claim 5, wherein said vapor recovery pump further includes a vapor flow director for providing optimum vapor flow through said pump.

7. A vapor recovery system comprising:

a fuel dispensing nozzle capable of recovering fuel vapors;

a fuel dispensing hose connected at one end to said nozzle and designed for delivering fuel to and recovering fuel vapors from said fuel dispensing nozzle;

a vapor recovery pump cooperatively connected to said fuel dispensing hose for controllably collecting recovered fuel vapors;

a dispensing unit for controlling fuel delivery;

at least one fuel storage tank containing both fuel and vapor storage space;

fuel dispensing and vapor recovery lines extending between said dispensing unit and said at least one tank;

wherein vapor pressure is maintained in said at least one tank within a certain pre-defined range solely as a result of said vapor recovery pump automatically adjusting the ratio of collected fuel vapors to dispensed fuel in response to changes in vapor pressure in said at least one tank.

8. The system of claim 7, wherein said vapor recovery pump is fluid driven.

9. The system of claim 8, wherein said vapor recovery pump comprises a rotor which selectively rotates in response to fuel flow.

10. The system of claim 7, wherein said vapor recovery pump is electrically driven.

11. The system of claim 7, further including at least one vapor venting line extending from said at least one tank into the atmosphere.

12. The system of claim 11, wherein said at least on vapor venting line includes at least one pressure/vacuum valve for selectively controlling vapor pressure in said at least one tank.

13. The system of claim 7, wherein said vapor recovery pump comprises a rotor which selectively rotates in response to fuel flow.

14. The system of claim 7, wherein said vapor recovery pump further includes a fuel flow director located upstream of the rotor.

15. The system of claim 7, where in said vapor recovery pump further includes a vapor impeller for pumping recovered fuel vapors for collection by said at least one fuel storage tank.

16. The system of claim 7, wherein said vapor recovery pump further includes a vapor flow director for providing optimum vapor flow through said pump.

* * * * *